US011092328B2

(12) United States Patent
Liu et al.

(10) Patent No.: US 11,092,328 B2
(45) Date of Patent: Aug. 17, 2021

(54) LAMP AND METHOD FOR ASSEMBLING A LAMP

(71) Applicant: LEDVANCE GmbH, Garching bei München (DE)

(72) Inventors: Jun Liu, Guangdong (CN); Shijun Nie, Guangdong (CN); Haitao Wen, Guangdong (CN)

(73) Assignee: LEDVANCE GMBH, Garching (DE)

( * ) Notice: Subject to any disclaimer, the term of this patent is extended or adjusted under 35 U.S.C. 154(b) by 0 days.

(21) Appl. No.: 15/854,977

(22) Filed: Dec. 27, 2017

(65) Prior Publication Data

US 2018/0187880 A1 Jul. 5, 2018

(30) Foreign Application Priority Data

Dec. 30, 2016 (CN) ..... 201611261529.4

(51) Int. Cl.

| | |
|---|---|
| ***F21V 1/00*** | (2006.01) |
| ***F21V 11/00*** | (2015.01) |
| ***F21V 31/00*** | (2006.01) |
| ***F21V 23/06*** | (2006.01) |
| ***F21V 3/00*** | (2015.01) |
| ***F21V 19/00*** | (2006.01) |
| ***F21S 2/00*** | (2016.01) |
| ***F21V 29/70*** | (2015.01) |
| ***F21V 23/00*** | (2015.01) |
| ***F21V 17/10*** | (2006.01) |
| ***F21K 9/90*** | (2016.01) |
| ***F21K 9/232*** | (2016.01) |
| ***F21V 31/04*** | (2006.01) |
| *F21Y 115/10* | (2016.01) |
| *F21Y 107/00* | (2016.01) |

(52) U.S. Cl.

CPC ..... *F21V 31/005* (2013.01); *F21K 9/232* (2016.08); *F21K 9/90* (2013.01); *F21S 2/005* (2013.01); *F21V 3/00* (2013.01); *F21V 17/101* (2013.01); *F21V 19/0015* (2013.01); *F21V 23/003* (2013.01); *F21V 23/006* (2013.01); *F21V 23/06* (2013.01); *F21V 29/70* (2015.01); *F21V 31/04* (2013.01); *F21Y 2107/00* (2016.08); *F21Y 2115/10* (2016.08)

(58) Field of Classification Search

CPC ..... F21V 31/005; F21V 29/763; F21V 31/04; F21V 21/00; F21V 23/006; F21V 23/06; F21V 3/00; F21V 19/0015; F21V 29/70; F21V 23/003; F21V 17/101; F21K 9/233; F21K 9/23; F21K 9/90; F21K 9/232; B60Q 1/0088; B60Q 1/2696; B60Q 1/2623; F21S 41/00; F21S 2/005; F21Y 2107/00; F21Y 2115/10

See application file for complete search history.

(56) References Cited

U.S. PATENT DOCUMENTS 5,931,577 A * 8/1999 Ishibashi ..... F21S 4/22 362/249.04
2008/0062708 A1* 3/2008 Kolstee ..... F21V 31/04 362/520

(Continued)

*Primary Examiner* — Thien T Mai
(74) *Attorney, Agent, or Firm* — Hayes Soloway PC

(57) ABSTRACT

A lamp is provided, the lamp comprising at least one LED module and a first housing part, wherein the LED module is sealed to the first housing part against environmental influences jointly by a first sealing member and a sealing compound.

20 Claims, 7 Drawing Sheets

(56) References Cited

U.S. PATENT DOCUMENTS

| | | | | |
|---|---|---|---|---|
| 2014/0043802 | A1* | 2/2014 | Dings | F21V 15/013<br>362/221 |
| 2017/0051910 | A1* | 2/2017 | Woytowitz | F21V 31/005 |

* cited by examiner

LAMP AND METHOD FOR ASSEMBLING A LAMP

CROSS-REFERENCE TO RELATED APPLICATION(S)

This patent application claims priority from Chinese Patent Application No. 201611261529.4, filed on Dec. 30, 2016, which is herein incorporated by reference in its entirety.

TECHNICAL FIELD

The present invention relates to a lamp and a method for assembling a lamp.

BACKGROUND

Lamps that are intended for use in wet and/or dusty environments, such as lamps for bathrooms or lamps for outdoor illumination, require a protection against environmental influences. Currently available lamps for such applications only comprise a single sealing compound or a single sealing member. However, using only one sealing compound or sealing member is not very reliable and results in easy breakage of the lamp due to environmental influences.

SUMMARY OF THE INVENTION

It is one object of the present invention to provide a lamp with an improved protection against environmental influences, in particular water and/or dust. A further object of the present invention is to provide a method for assembling a lamp with an improved protection against environmental influences.

These objects are solved by a lamp and a method for assembling a lamp according to the independent claims. Preferred embodiments are given by the dependent claims, the specification and the figures.

Accordingly, a lamp is provided comprising at least one LED module and a first housing part. The at least one LED module is sealed to the first housing part, in particular against environmental influences, jointly by a first sealing member and a sealing compound. The first housing part may be a retainer for the LED module.

Owing to the combined use of at least two sealing means, i.e., the sealing compound and the first sealing member, an improved seal for a lamp may be provided. Since at least two different sealing means are used, destroying one sealing means does not necessarily result in breakage of the entire lamp due to environmental influences.

Hereinafter, a sealing or a seal of a component may be a mechanical protection of the component from the environment. Further, a first component being sealed to a second component may mean that the connection between the first and the second component is sealed against environmental influences. In particular, a sealing may help join the components of the lamp together and prevent contamination by environmental influences. For example, the component may be waterproof and/or dust protected owing to the sealing. The sealing may be provided by the sealing compound and/or the first sealing member only. Alternatively, further components of the lamp may contribute to the sealing. Furthermore, a sealing may provide protection from electrical flashover. For this, the sealing compound and/or the first sealing member may consist of an electrically insulating material.

In addition, here and in the following "jointly sealed" can mean that the LED module is mainly sealed to the first housing part by the first sealing member or the sealing compound, wherein the other sealing means only acts as a backup sealing means if the first sealing member or the sealing compound breaks or is damaged. Alternatively, a joint seal may mean that the seal is only provided by a combination of the two sealing means. That is to say, both sealing means may be required for providing the seal.

The lamp is preferably an HQL LED lamp. An HQL lamp is a mercury-vapor lamp, wherein HQL is the abbreviation for the corresponding German word "Hochdruck-Quecksilberdampflampe". An HQL LED lamp may be a lamp with light-emitting diodes as lighting means, wherein the HQL LED lamp can replace a regular HQL lamp. Alternatively, the lamp may comprise LED filaments as lighting means. The light-emitting diode may be part of the at least one LED module.

The second housing part of the lamp may be a multi-part second housing part. The second housing part may comprise a metal or consist of at least one metal. The sealing compound is at least partially filled into a hollow space in between a second housing part and the first housing part. For example, the second housing part may comprise a cavity into which a part of the LED module and/or the first housing may be installed. The cavity may be at least partially filled with the sealing compound. The lamp may further comprise a driver for the LED module. In this case, the entire hollow space in between the second housing part, the first housing part, the driver and the LED module may be filled with the sealing compound.

Preferably, the sealing compound is waterproof and/or dust protected. Additionally or alternatively, the first sealing member may be waterproof and/or dust protected. The lamp may further comprise a second sealing member that is preferably waterproof and/or dust protected. "Waterproof" may correspond to "splash proof", wherein "splash proof" means that water splashing against the sealing means does not have any harmful effect on the sealing means and/or does not penetrate the sealing means. Preferably, "waterproof" corresponds to "water-jet proof", i.e. water projected by a nozzle onto the sealing means for at least one minute does not have any harmful effect on the sealing means and/or does not penetrate the sealing means. Further, a sealing means may be dust protected if ingress of dust into the sealing means is not entirely prevented, but the quantity of the intruded dust is small enough to not interfere with the satisfactory operation of the lamp. Preferably, "dust protected" means "dust tight", i.e. there is no ingress of dust into the sealing means.

According to a preferred embodiment of the lamp, the first sealing member is in direct contact with the sealing compound and the sealing compound is at least partially filled into a gap in between the first sealing member and the first housing part. The seal by the first sealing member may then be improved by the sealing compound.

According to at least one embodiment of the lamp, the first sealing member seals a mechanical connection between the LED module and the first housing part. Preferably, the first sealing member seals connection leads of the LED module and protects the electronics parts of the LED module from water penetration. The connection leads may be adapted for electrically connecting the light-emitting diode of the LED module from outside.

According to a further embodiment of the lamp, the LED module comprises a connector through which the connection leads of the LED module are fed. The first sealing member is an O-ring that is positioned at the connector. The connector may be an opening in a carrier of the LED module. In particular, the connector may be a flange. The connection leads may be electrically connected to at least one light-emitting diode of the LED module. The connection leads may protrude through the connector and out of the LED module. For example, the connection leads are metal connections.

The first housing part may comprise a further connector that may correspond to a cavity in the first housing part. The connector of the LED module and the further connector of the first housing part may have corresponding sizes. The further connector may also be a flange. It is possible for the LED module to be mounted on the first housing part such that the connector and the further connector are arranged with respect to each other, wherein the O-ring seals the connection of the two connectors. In the case of the LED module being mounted to the first housing part, the connection leads may project through the connector and the further connector. The connection leads may then be positioned in the cavity of the first housing part. The cavity may have electric connections for electrically connecting the connection leads to a lamp base of the lamp. When connected with the further connector, the connection leads of the LED module may be electrically connected to the electric connections in the cavity.

According to at least one embodiment of the lamp, the LED module comprises at least one light-emitting diode. Preferably, the LED module comprises a plurality of light-emitting diodes. The light-emitting diode, preferably the plurality of light-emitting diodes, is sealed by a second sealing member. Here, further components of the LED module may contribute to the sealing of the light-emitting diode.

According to at least one embodiment of the lamp, the LED module comprises a light-transmitting cover and a carrier for mounting the at least one light-emitting diode. The cover is positioned at a topside of the light-emitting diode that faces away from the carrier. Preferably, the cover faces a light-exit area of the at least one light-emitting diode, wherein light emitted by the light-emitting diode exits the light-emitting diode through the light-exit area. The cover may then be a light-emission window of the LED module through which light emitted by the at least one light-emitting diode leaves the LED module.

The carrier and the cover may extend along a, preferably common, main extension plane. Perpendicular to the main extension plane, the cover and the carrier may respectively have a thickness. The thickness of the cover and the carrier may be small compared to the extension of the cover and the carrier along the main extension plane, respectively.

It is possible for the cover and the carrier to have an identical or similar shape and size along the main extension plane. In this context, the carrier and the cover have a similar size if the extension of the carrier and the cover along the main extension plane differs by at most 10%, preferably at most 5%. For example, the carrier may be rectangular; the cover may then also be rectangular, with the extension of the long side and the short side of the cover being at most +/−10% of the extension of the long side and the short side of the carrier, respectively.

The light-transmitting cover may consist of a light-transmitting material, such as a light-transmitting glass and/or a light-transmitting plastic. Hereinafter, "light-transmitting" may mean that at least 60%, preferably at least 80%, of the light emitted by the at least one light-emitting diode and impinging on the light-transmitting cover is transmitted through the cover.

The carrier may be a mechanically stabilizing component for the at least one light-emitting diode. That is to say, for holding and/or carrying the light-emitting diode, no further mechanically stabilizing means may be required. Preferably, the carrier is connected to or comprises a cooling body, such as a heat sink. The cooling body may be provided at a side of the carrier that faces away from the light-emitting diodes. The carrier may comprise a heat-conducting material that allows for guiding waste heat produced during operation of the at least one light-emitting diode away from the light-emitting diode and to the cooling body.

Preferably, the second sealing member is positioned in between the cover and the carrier. The second sealing member may be in direct contact with the cover and the carrier. The second sealing member may provide a firm bond between the cover and the carrier. Additionally or alternatively, the carrier and the cover may be connected by a mechanically releasable connection, for example by the use of terminals. Hereinafter, a firm bond is a bond that may only be released by destroying the bonding member, for example by using a solvent. For example, an adhesive bond is a firm bond. Further, a mechanically releasable connection may be released without destroying the connecting components. For example, a form-fitting connection is a mechanically releasable connection.

The light-emitting diode is sealed by, preferably only by, the second sealing member, the cover, and the carrier. Here, the second sealing member frames the at least one light-emitting diode, preferably the plurality of light-emitting diodes. That is to say, in a top view onto the light-emitting diode, the second sealing member surrounds the light-emitting diode in its entirety.

The second sealing member may be positioned along an outer frame of the cover and/or the carrier. The outer frame of the cover and/or the carrier may respectively correspond to an outer rim of the cover and/or the carrier. The outer frame may run parallel to the main extension plane. In the top view, the second sealing member may take the shape of the cover and/or the carrier. The light-emitting diode may be free of the second sealing member. That is to say, the light-emitting diode is not in direct contact with the second sealing member and the light-exit area of the light-emitting diode is not covered by the second sealing member.

It is possible that the LED module is sealed by the second sealing member, the cover, and the carrier. The cover and the carrier may then be an outer part of the LED module. In this regard, the LED module may still be seen as being sealed if there is an opening in the carrier for connection leads to be fed through said opening. This opening may, for example, be sealed with a first sealing member. The LED module may then be sealed in its entirety by the second sealing member and the first sealing member, in connection with the cover and the carrier.

According to at least one embodiment of the lamp, the second sealing member is a sealing glue and/or the sealing compound is a potting glue. A sealing glue or a sealing compound may comprise or consist of a potting material that is waterproof and/or dust protected. For example, a sealing glue or a potting glue may comprise a silicone and/or an epoxy resin or may consist of at least one of these materials.

According to at least one embodiment, the lamp comprises a plurality of LED modules. Each LED module comprises at least one light-emitting diode, preferably a plurality of light-emitting diodes. The sealing compound is at least partially positioned in a gap between the LED modules.

Preferably, each LED module comprises a light-transmitting cover and a carrier. The LED modules are arranged on the first housing part of the lamp such that the carriers face each other and at least a part of a gap between the carriers is filled with the sealing compound. For example, each LED module comprises a cooling body that is comprised by or in contact with the carrier, wherein the cooling bodies face each other. The sealing compound may then be arranged in between the cooling body. Preferably, the sealing compound comprises a heat-conducting material. It may be possible for the sealing compound to be in direct contact with at least one carrier of the LED modules.

According to a preferred embodiment, the LED module and/or the lamp is waterproof. That is to say, the LED module and/or the lamp is splash proof and preferably protected against water jets.

Preferably, the LED module and/or the lamp satisfies IP Code IP 65 according to IEC standard 60529. The IP Code (International Protection Marking) according to IEC standard 60529 classifies and rates the degree of protection provided against dust and water by mechanical casings and electrical enclosures. The equivalent British standard is EN 60529. IP 65 may correspond to a NEMA enclosure rating (NEMA: National Electrical Manufacturers Association) of at least 4. The first digit of the IP Code refers to solid particle protection, whereas the second digit refers to liquid ingress protection. IP 65 refers to a dust tight solid particle protection (level sized 6) and a protection against water jets regarding the liquid ingress protection (level sized 5). Fulfilling IP 65 is, for example, required for lamps that intended for use in a wet and/or dusty environment, such as lamps for wet rooms, e.g. bathrooms, or outdoor illumination.

Further, a method for assembling a lamp is provided. Preferably, the method is used for assembling a lamp as described above. That is to say, all features disclosed in connection with the lamp are also disclosed for the method and vice versa.

In a first method step, at least one LED module, a second housing part, and a first housing part are provided. Then, the LED module is mechanically connected to the first housing part. Here, wherein the LED module is sealed to the first housing part by a first sealing member. Then, the LED module, and preferably the first housing part, is positioned in the second housing part. Afterwards, a sealing compound is filled into a hollow space in between the second housing part, the driver and the LED module. In a further step of the method, the sealing compound may be cured, for example via thermal curing.

According to at least one embodiment of the method, providing the LED module comprises the step of providing a light-transmitting cover and a carrier onto which at least one light-emitting diode is positioned. Further, providing the LED module comprises the step of applying a second sealing member onto an outer frame of the cover and/or onto an outer frame of the carrier. The cover and the carrier are then connected, wherein a firm bond in between the cover and the carrier is provided by the second sealing member. Hereinafter, an outer frame may correspond to an outer rim of the cover and/or the carrier. The outer frame may run parallel to the main extension plane.

Preferably, the sealing compound and/or the second sealing member is cured. The sealing compound may be cured after being filled into the second housing part. Accordingly, the second sealing member may be cured after the cover and the carrier have been connected. The curing may be performed by the use of thermal curing. After the curing step, the sealing compound and/or the second sealing member may be hardened, thus providing a sealing.

BRIEF DESCRIPTION OF THE DRAWINGS

Preferred embodiments of the invention will be explained in the following, having regard to the drawings.

DETAILED DESCRIPTION OF THE INVENTION

Figure 1:
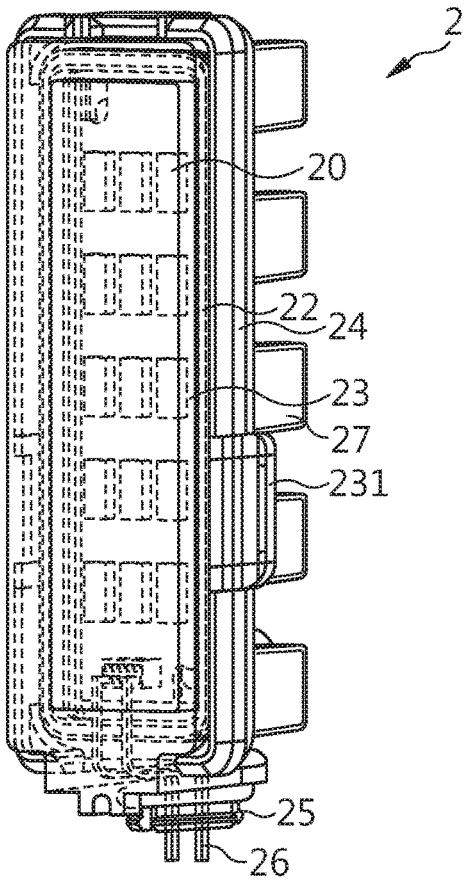
FIG. 1 shows an embodiment of an LED module for a lamp according to the present invention.

In the following, preferred embodiments of the invention will be described with reference to the drawings. Here, elements that are identical, similar or have an identical or similar effect are provided with the same reference numerals in the figures. The figures and the size relationships of the elements illustrated in the figures among one another should not be regarded as to scale. Rather, individual elements may be illustrated with an exaggerated size to enable better illustration and/or better understanding.

With reference to the schematic drawing of FIG. 1A, an embodiment of an LED module 2 for a lamp 1 according to the present invention is described in detail. The LED module 2 comprises a plurality of light-emitting diodes 20, a second sealing member 22, a light-transmitting cover 23, a carrier 24, a connector 25, connection leads 26, and a cooling body 27. The light-emitting diodes 20 are mounted on the carrier 24 and covered by the cover 23. The light-emitting diodes 20 are further framed by the second sealing member 22. The second sealing member 22 is positioned in between the cover 23 and the carrier 24.

The cooling body 27 is connected to the carrier 24 in order to lead heat generated by the light-emitting diodes 20 away from said diodes. The cooling body 27 comprises cooling fans that are protrusions of the cooling body 27. The light-emitting diodes 20 are electrically conductively connected to the connecting leads 26. The connecting leads 26 are fed through the connector 25 for electrically connecting the light-emitting diodes 20.

For connecting the cover 23 to the carrier 24 and the cooling body 27, the cover 23 comprises first terminals 231 that are adapted for engaging with the carrier 24 and/or the cooling body 27. Thereby, a mechanically releasable connection between the carrier 24 and the cover 23 may be provided. It is further or alternatively possible for the second sealing member 22 to provide an adhesive bond between the carrier 24 and the cover 23.

Figure 2A:
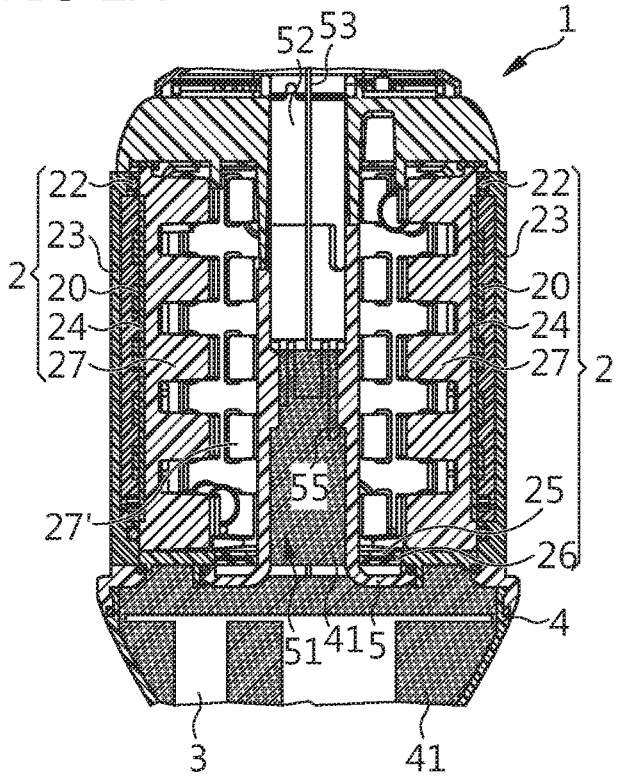
FIGS. 2A and 2B show embodiments of a lamp according to the present invention.
Figure 2B:
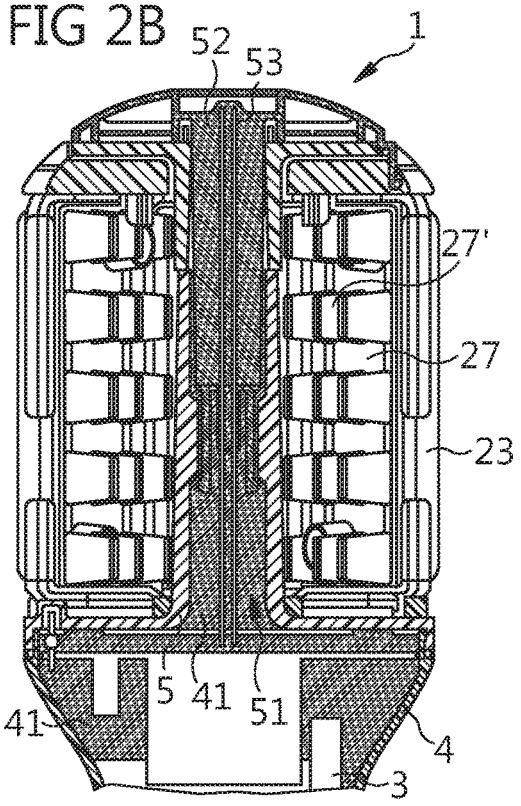

With reference to the schematic drawing of FIGS. 2A and 2B, embodiments of a lamp 1 according to the present invention are described in detail. The lamp 1 comprises a plurality of LED modules 2. Here, further cooling bodies 27' of further LED modules 2 are depicted for ease of understanding of the assembly. The LED module 2 of the lamp 1 according to FIG. 2A has been described in connection with FIG. 1A.

The respective lamp 1 according to FIG. 2A or FIG. 2B further comprises a driver 3, a second housing part 4, a first housing part 5 with a middle pillar 52 and a sealing compound 41. The components of the lamp 1 are arranged in the second housing part 4.

The LED modules 2 are positioned on the first housing part 5 around the middle pillar 52. Here, the carriers 24 and the cooling bodies 27 of the LED modules 2 face each other. The LED modules 2 may be positioned along a circle around the middle pillar 52. A main extension plane of each LED module 2 may run along a main extension direction of the middle pillar 52.

The sealing compound 41 is at least partly filled into a hollow space in between the LED modules 2, the first housing part 5, the driver 3, and the second housing part 4. In particular, the sealing compound 41 is partially positioned in a gap 51 in between the LED modules 2 and the first housing part 5. Said gap 51 occurs due to the middle pillar 52 of the first housing part 5 only partly extending along the LED modules 2. In other words, a maximum extension of the LED modules 2 along the main extension plane is larger than a maximum extension of the middle pillar 52 along its main extension direction.

Inside the middle pillar 52, a further connector 53 may be provided. The further connector 53 may be suitable for electrically connecting further LED modules 2 that may be positioned on top of the middle pillar 52.

The first housing part 5 further may comprise protrusions 55 extending out of the middle pillar 52 into the gap 51. Said protrusions 55 may enable a better connection of the LED modules 2 to the first housing part 5. The protrusions 55 may also allow for improving adherence of the sealing compound 41 in the gap 51.

Figure 3A:
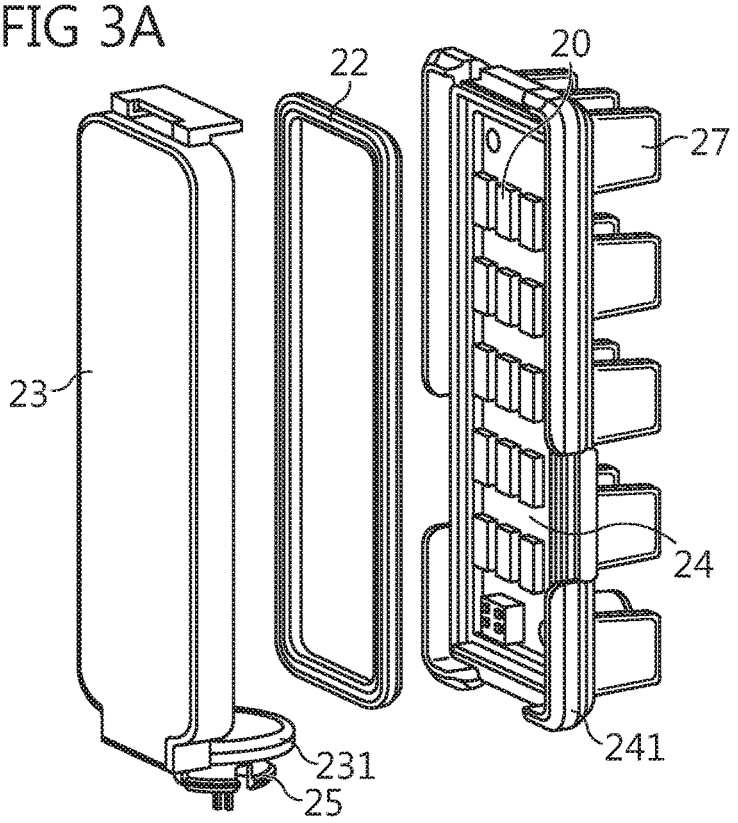
FIGS. 3A and 3B show an embodiment of a method for providing an LED module and an embodiment of an LED module for a lamp according to the present invention.
Figure 3B:
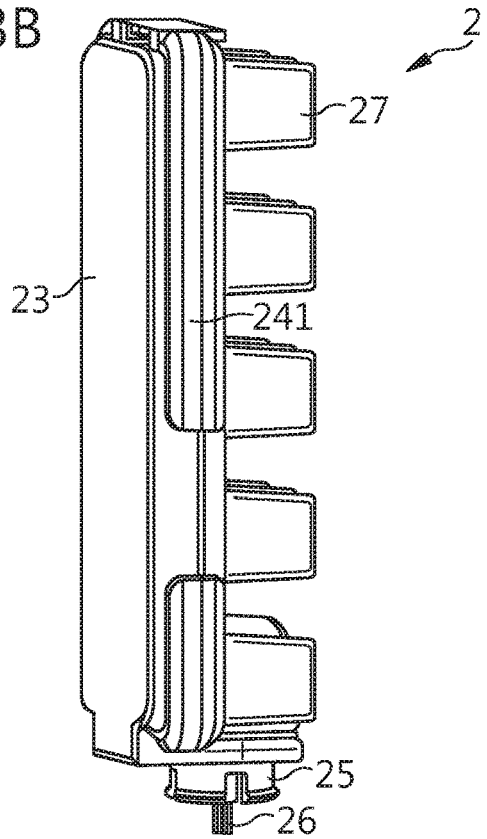

With reference to the schematic drawings of FIGS. 3A and 3B, a method for providing an LED module 2 for a lamp according to the present invention is described in detail. In a first method step, shown in FIG. 3A, a cover 23, a second sealing member 22 and a carrier 24 are provided. In a further method step, the cover 23, the second sealing member 22 and the carrier 24 are connected in order to provide an LED module 2 (shown in FIG. 3B).

As shown in FIG. 3A, a plurality of light-emitting diodes 20 is mounted to the carrier 24. Further, a cooling body 27 is attached to the carrier 24. The cover 23 comprises first terminals 231 and the carrier 24 comprises second terminals 241. By means of the first terminals 231 and the second terminals 241, a mechanically releasable connection of the cover 23 to the carrier 24 may be provided.

The second sealing member 22 is positioned such that it frames the light-emitting diodes 20. The second sealing member 22 has a similar shape to an outer rim of the cover 23 and the carrier 24. In particular, the second sealing member 22, the cover 23 and the carrier 24 are shaped rectangular.

The second sealing member 22 may also be provided as a liquid adhesive, for example a sealing glue, that is applied to the cover 23 and/or the carrier 24. The cover 23 and the carrier 24 may then be connected due to an adhesive bond.

Figure 4A:
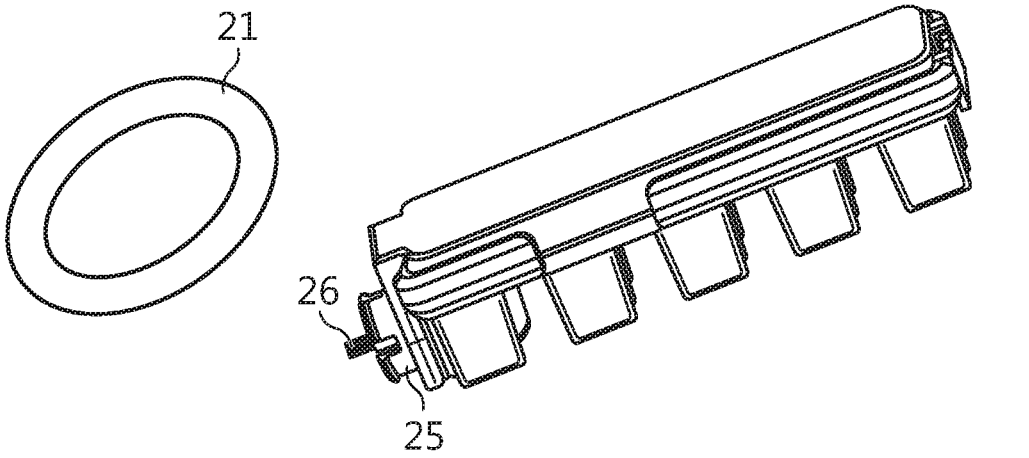
FIGS. 4A, 4B, 4C, 4D and 4E show an embodiment of a method for assembling a lamp and an embodiment of a lamp according to the present invention.
Figure 4B:
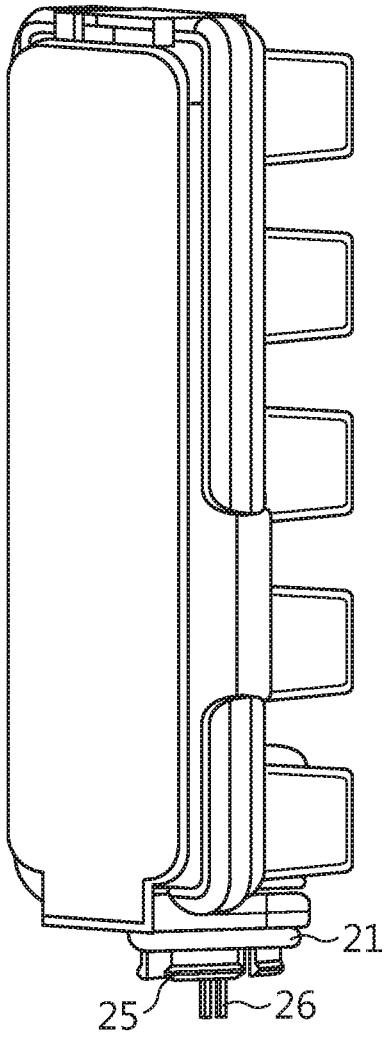

With reference to the schematic drawings of FIGS. 4A to 4E, method steps of a method for assembling a lamp 1 according to the present invention are described in detail. FIG. 4A shows a first method step, where an LED module 2 and a first sealing member 21 are provided. In the shown embodiment, the first sealing member 21 is an O-ring. The LED module 2 comprises a connector 25 through which connecting leads 26 of the LED module 2 are fed. The connector 25 may be a flange or may be similar to a flange.

Figure 4C:
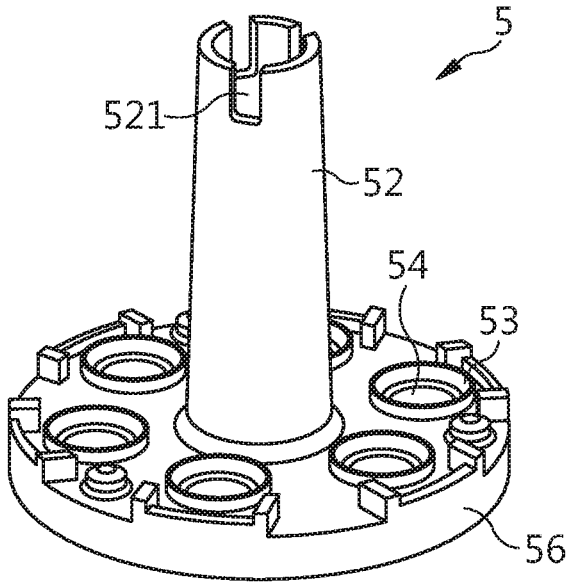

In a second method step (FIG. 4B), the O-ring is positioned at the connector 25 such that it surrounds the connecting leads 26. As shown in FIG. 4C, a first housing part 5 is provided. The first housing part has a disc-shaped holding part 56, comprising further connectors 53 that enclose cavities 53 in the first housing part 5, and a middle pillar 52. The further connector 53 may be adapted for being connected with the connector 25 of the LED module 2. For this, the LED module 2 may be positioned onto the first housing part 5.

The middle pillar 52 has indentations 521 that may help to improve a connection of a second housing part 4 of the lamp 1 to the first housing part 5. For example, the middle pillar 52 may be flexible due to the indentations 521; in this case, a part of the second housing part 4 may be plugged into the middle pillar 52, wherein size differences of the middle pillar 52 and the part of the second housing part 4 due to manufacturing may be compensated by the flexibility given by the indentations 521.

Figure 4D:
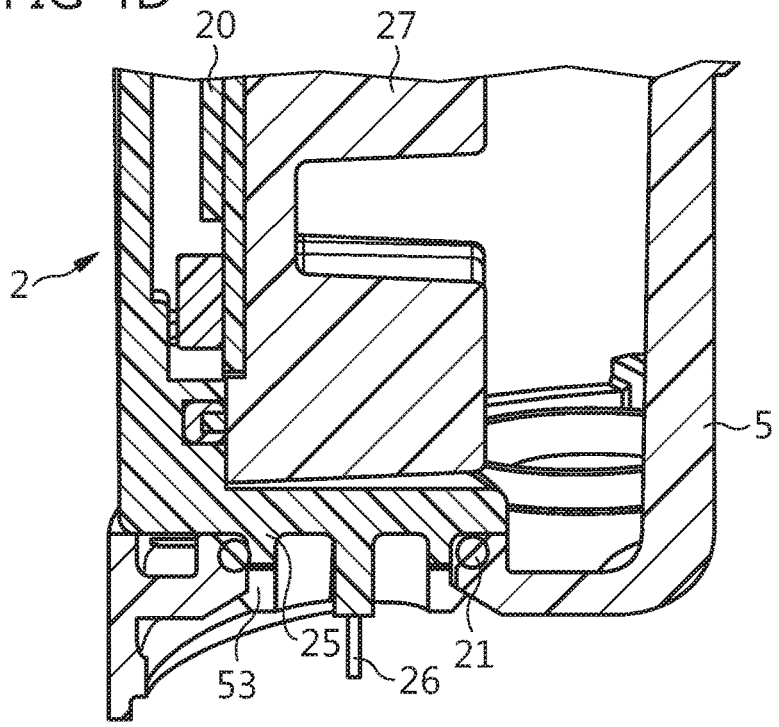

FIG. 4D shows an enlargement of the LED module 2 and the first housing part 5 that are connected to each other. The O-ring 21 is positioned at the connector 25 and the further connector 53, thereby sealing the connecting leads 26 of the LED module 2.

Figure 4E:
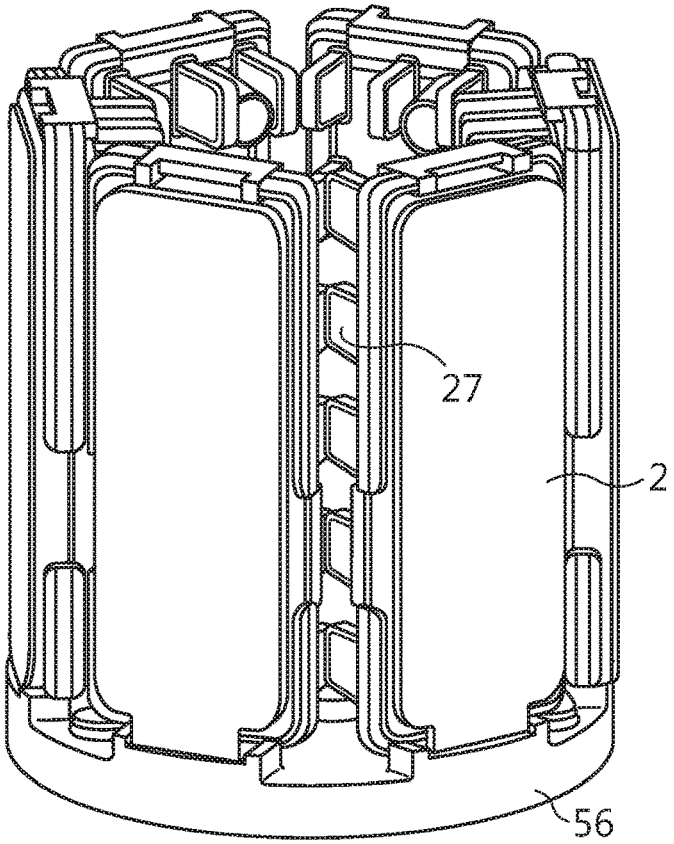

In FIG. 4E, an assembly of the first housing part 5 and a plurality of LED modules 2 is shown. The LED modules 2 are positioned on the disc-shaped holding part 56 of the first housing part 5 such that the cooling bodies 27 and the carriers 24 of the LED modules 2 face each other. The LED modules 2 surround the middle pillar 52 of the first housing part 5.

Figure 5A:
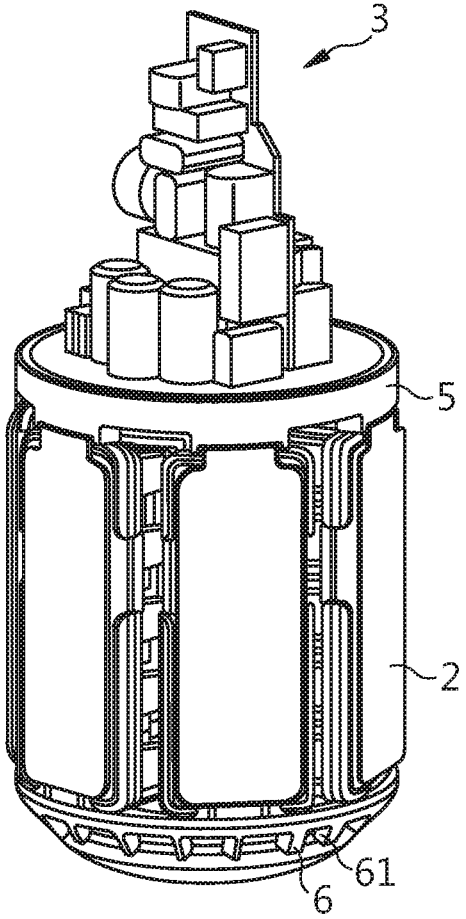
FIGS. 5A, 5B, 5C and 5D show an embodiment of a method for assembling a lamp and an embodiment of a lamp according to the present invention.
Figure 5B:
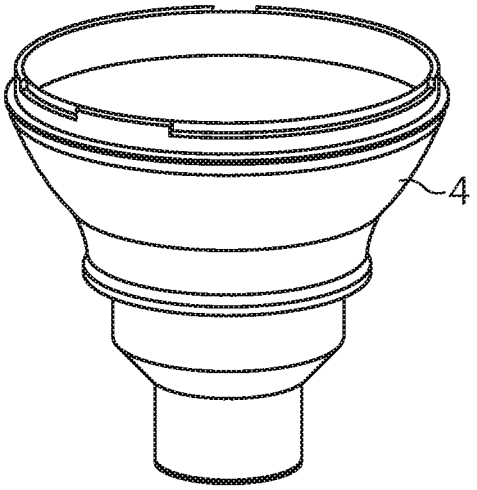
Figure 5C:
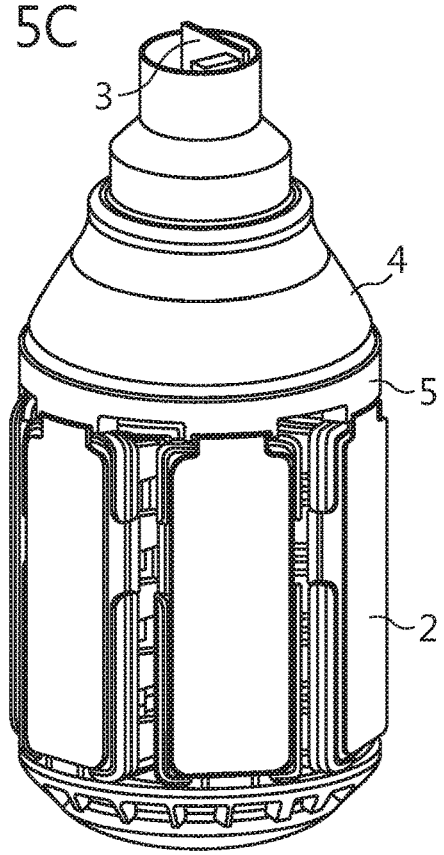

With reference to the schematic drawings of FIGS. 5A to 5C, further method steps of a method for assembling a lamp 1 according to the present invention and a lamp 1 according to present invention are described in detail. In FIG. 5A, an assembly with a plurality of LED modules 2 and a first housing part 5 is provided. Said assembly is connected to a driver 3. The driver 3 comprises electronic components for controlling the LED modules 2 and in particular the light-emitting diodes 20 of the LED modules 2. Further, a cap 6 is provided on a side of the assembly facing away from the driver 3. The cap 6 comprises perforations 61 that may improve heat dissipation of the lamp 1.

As shown in FIG. 5B, a second housing part 4 is provided. The second housing part 4 may be composed of several truncated cones and/or cylinders. The second housing part 4 preferably is adjusted for receiving the driver 3 and at least part of the assembly comprising the first housing part 5 and the LED modules 2.

Figure 5D:
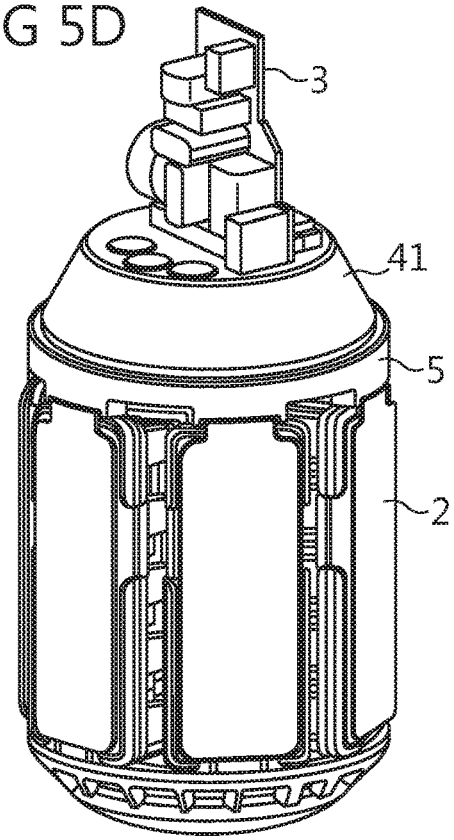

In FIG. 5C, the second housing part 4 is put over the driver 3 and connected to the first housing part 5. Then, a sealing compound 41 is filled into the second housing part 4. FIG. 5D shows an inside of the lamp 1 of FIG. 5C, where the second housing part 4 is not shown for ease of understanding. In FIG. 5D, the sealing compound 41 is already cured. The sealing compound 41 encloses parts of the driver 3 and is in direct contact with the first housing part 5. Thereby, a seal of the LED modules 2 and at least parts of the driver 3 is provided.

Figure 6:
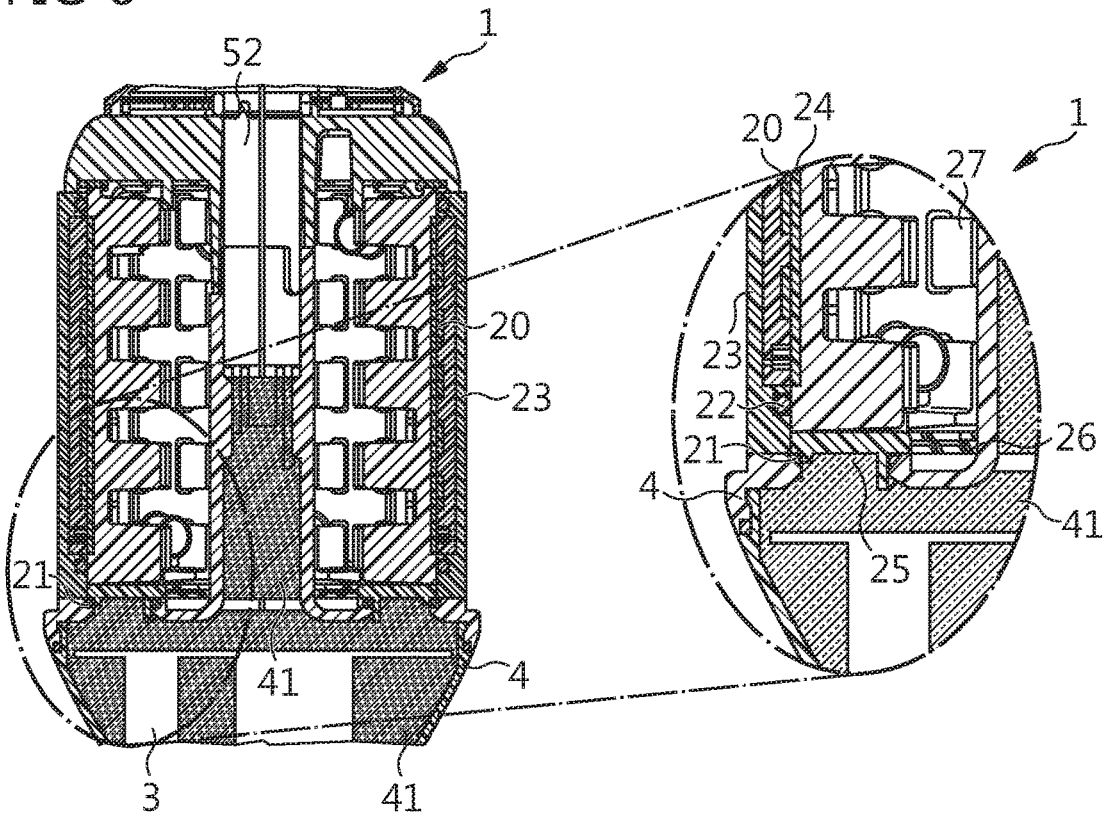
FIGS. 6 and 7 show embodiments of a lamp according to the present invention.
Figure 7:
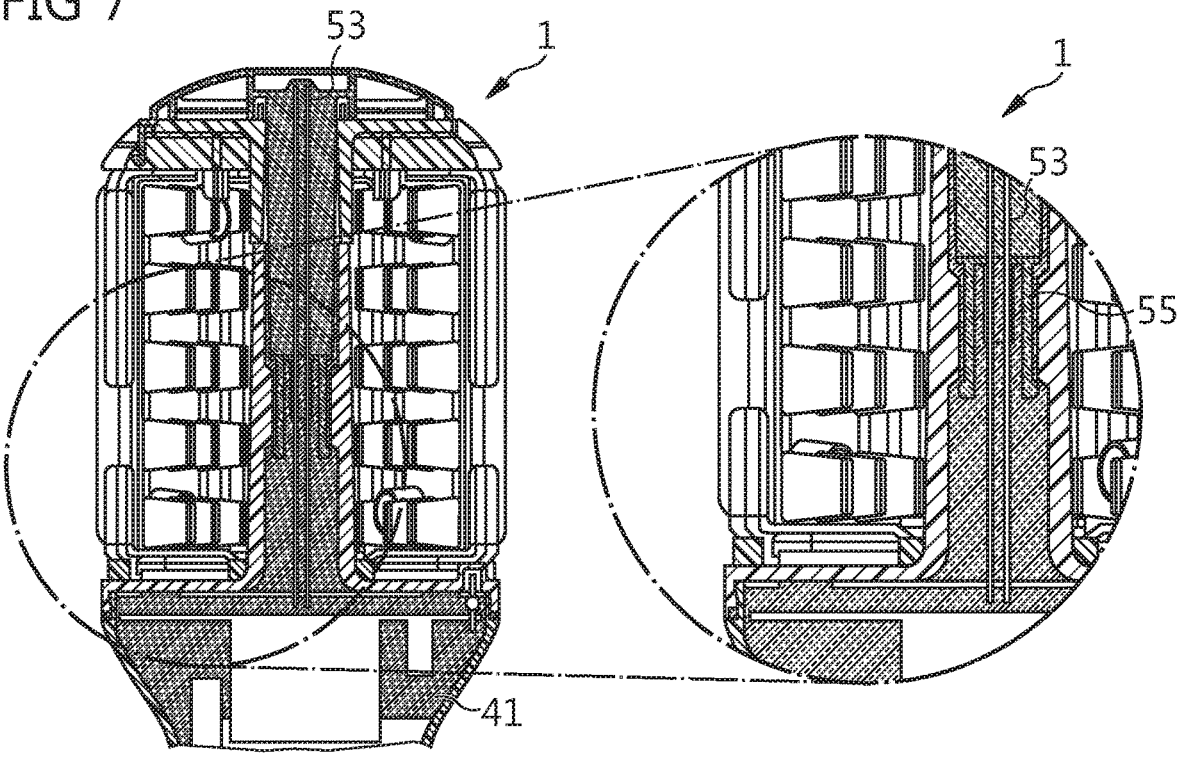

With reference to the schematic drawings of FIGS. 6 and 7, embodiments of a lamp 1 according to the present invention are described in detail. Here, FIG. 6 shows the lamp 1 as shown in FIG. 2A and FIG. 7 shows a lamp 1 as shown in FIG. 2B, wherein in both figures an enlarged cutout of the lamp 1 is shown. Each lamp 1 comprises a sealing compound 41 for sealing a hollow space in between an LED module 2, a first housing part 5 and a driver 3 and enclosed by a second housing part 4. In the embodiment of FIG. 7, a further connector 53 of the first housing part 5 extends through the middle pillar 52 and along the entire LED modules 2.

As can be seen in the respective cutout, the sealing compound 41 may be filled into a gap between the first sealing member 21 and the first housing part 5. The sealing compound 41 may then be in direct contact with the first sealing member 21. By this, the sealing by the first sealing member 21 may be further improved due to the sealing compound 41. Further, in the case of breakage of the sealing by one of the first sealing member 21 or the sealing compound 41, the remaining sealing means may still seal the LED module 2, thereby making the lamp 1 more reliable.

The invention is not restricted by the description based on the embodiments. Rather, the invention comprises any new feature and also any combination of features, including in particular any combination of features in the patent claims, even if this feature or this combination itself is not explicitly specified in the patent claims or exemplary embodiments.

LIST OF REFERENCE NUMERALS

1 Lamp
2 LED module
20 Light-emitting diode
22 Second sealing member
21 First sealing member
23 Light-transmitting cover
231 First terminals
24 Carrier
241 Second terminals
25 Connector
26 Connection leads
27 Cooling body
3 Driver
4 Second housing part
41 Sealing compound
5 First housing part
51 Gap
52 Middle pillar
521 Indentation
53 Further connector
54 Cavity
55 Protrusion
56 Holding part
6 Cap
61 Perforation

The invention claimed is:

1. A lamp comprising:

at least one light-emitting diode (LED) module; and a first housing part;

wherein the at least one LED module is sealed to the first housing part jointly by a first sealing member and a sealing compound such that the sealing joins the at least one LED module and the first housing part together and protects a connection between the at least one LED module and the first housing part against environmental influences, wherein the first sealing member at least partially surrounds a portion of the at least one LED module.

2. The lamp according to claim 1, wherein the sealing compound is at least partially filled into a hollow space in between a second housing part and the first housing part.

3. The lamp according to claim 1, wherein at least one of the sealing compound and the first sealing member is at least one of waterproof and dust protected.

4. The lamp according to claim 1, wherein the first sealing member is in direct contact with the sealing compound, and wherein the sealing compound is at least partially filled into a gap in between the first sealing member and the first housing part.

5. The lamp according to claim 1, wherein the first sealing member seals a mechanical connection between the at least one LED module and the first housing part.

6. The lamp according to claim 5, wherein the LED module comprises a connector through which connection leads of the at least one LED module are fed, and wherein the first sealing member is an O-ring that is positioned at the connector.

7. The lamp according to claim 1, wherein the at least one LED module comprises at least one light-emitting diode, and wherein the light-emitting diode is sealed by a second sealing member.

8. The lamp according to claim 7, wherein the at least one LED module comprises a light-transmitting cover and a carrier for mounting the at least one light-emitting diode, the light-transmitting cover being positioned at a topside of the at least one light-emitting diode that faces away from the carrier, wherein the second sealing member is positioned in between the light-transmitting cover and the carrier and frames the at least one light-emitting diode, and wherein the at least one light-emitting diode is sealed by the second sealing member, the light-transmitting cover, and the carrier.

9. The lamp according to claim 7, wherein at least one of the second sealing member is a sealing glue and the sealing compound is a potting glue.

10. The lamp according to claim 1, wherein the at least one LED module comprises a plurality of LED modules, each LED module comprising at least one light-emitting diode, wherein the sealing compound is at least partially positioned in a gap between the LED modules.

11. The lamp according to claim 10, wherein each LED module comprises a light-transmitting cover and a carrier, and wherein the LED modules are arranged on a first housing part of the lamp such that the carriers face each other and at least a part of a gap between the carriers is filled with the sealing compound.

12. The lamp according to claim 1, wherein at least one of the at least one LED module and the lamp is waterproof.

13. The lamp according to claim 1, wherein at least one of the at least one LED module and the lamp satisfies IP Code IP 65 according to IEC standard 60529.

14. A method for assembling a lamp, the method comprising:

providing at least one light-emitting diode (LED) module, a first housing part, and a second housing part;

mechanically connecting the at least one LED module to the first housing part, wherein the at least one LED module is sealed to the first housing part by a first sealing member;

positioning the at least one LED module in the second housing part; and filling a sealing compound into a hollow space in between the second housing part and the at least one LED module, wherein the first sealing member and the sealing compound jointly seal the at least one LED module to the first housing part such that the sealing joins the at least one LED module and the first housing part together and protects the connection between the at least one LED module and the first housing part against environmental influences, wherein the first sealing member at least partially surrounds a portion of the at least one LED module.

15. The method according to claim 14, wherein providing the at least one LED module comprises:

providing a light-transmitting cover and a carrier onto which at least one light-emitting diode is positioned;

applying a second sealing member at least one of onto an outer frame of the cover and onto an outer frame of the carrier; and connecting the light-transmitting cover and the carrier, wherein a firm bond in between the light-transmitting cover and the carrier is provided by the second sealing member.

16. The method according to claim 14, wherein at least one of the sealing compound and the second sealing member is cured.

17. The lamp according to claim 1, wherein:

an end of the at least one LED module includes an end connector; and the portion of the at least one LED module at least partially surrounded by the first sealing member is the end connector.

18. The lamp according to claim 17, wherein the end connector is provided at an end of a light-transmissive cover of the at least one LED module.

19. The lamp according to claim 17, wherein the at least one LED module further includes an electrical connection lead that passes through the end connector.

20. The lamp according to claim 1, wherein the at least one LED module includes an end connector and an electrical connection lead, both of which extend through the first sealing member.

* * * * *